US009009892B2

(12) United States Patent
Lachenbruch et al.

(10) Patent No.: US 9,009,892 B2
(45) Date of Patent: Apr. 21, 2015

(54) OCCUPANT SUPPORT AND TOPPER ASSEMBLY WITH LIQUID REMOVAL AND MICROCLIMATE CONTROL CAPABILITIES

(75) Inventors: Charles A Lachenbruch, Lakeway, TX (US); Timothy Joseph Receveur, Guilford, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/606,417

(22) Filed: Sep. 7, 2012

(65) Prior Publication Data

US 2013/0298330 A1 Nov. 14, 2013

Related U.S. Application Data

(60) Provisional application No. 61/645,361, filed on May 10, 2012.

(51) Int. Cl.

| | |
|---|---|
| ***A47B 13/00*** | (2006.01) |
| ***A61G 7/057*** | (2006.01) |
| *A61G 7/02* | (2006.01) |

(52) U.S. Cl.

CPC . *A61G 7/057* (2013.01); *A61G 7/02* (2013.01); *A61G 2007/05784* (2013.01); *A61G 2203/30* (2013.01)

(58) Field of Classification Search

CPC .. A47C 21/044; A47C 21/042; A47C 31/006; A61G 2007/05784

USPC ..... 5/606, 652.1, 652.2, 671, 672, 423, 5/714, 724, 726

See application file for complete search history.

(56) References Cited

U.S. PATENT DOCUMENTS

| | | | | | |
|---|---|---|---|---|---|
| 2,924,832 | A | * | 2/1960 | Knowles | 5/606 |
| 3,757,356 | A | | 9/1973 | Freeman | |
| 4,620,333 | A | * | 11/1986 | Ritter | 5/695 |
| 4,870,710 | A | * | 10/1989 | Hartmann | 5/606 |
| 5,244,457 | A | * | 9/1993 | Karami et al. | 602/55 |
| 5,380,278 | A | * | 1/1995 | Mombrinie | 604/35 |
| 5,549,584 | A | * | 8/1996 | Gross | 604/313 |

(Continued)

OTHER PUBLICATIONS

Skin IQ Microclimate Manager "Simplifying Skin Integrity", KCI Therapeutic Support Systems. © 2011, KCI Licensing, Inc. P.O. Box 659508, San Antonio, TX 78265-9508, 1-800-275-4524 or www.kciSkinIQ.com.

(Continued)

*Primary Examiner* — Peter M Cuomo
*Assistant Examiner* — Richard G Davis
(74) *Attorney, Agent, or Firm* — Kenneth C. Baran

(57) ABSTRACT

One embodiment of a topper assembly for a mattress comprises a liquid permeable cover layer, a liquid transport layer beneath the cover layer that directs liquid transport therethrough in a preferred direction, a liquid impermeable base layer beneath the transport layer, an air mover in fluid communication with the transport layer and a reservoir positioned downstream of the liquid transport layer. Operation of the air mover moves air and liquid through the liquid transport layer in the preferred direction such that the reservoir captures liquid discharged from the liquid transport layer. A related support apparatus comprises a mattress and a condition management assembly atop the mattress. The condition management assembly includes the liquid transport layer, the liquid impermeable base layer, the air mover and the reservoir.

22 Claims, 13 Drawing Sheets

(56) References Cited

U.S. PATENT DOCUMENTS

| | | | | |
|---|---|---|---|---|
| 5,588,167 | A * | 12/1996 | Pahno et al. | 5/606 |
| 5,640,728 | A | 6/1997 | Graebe | |
| 5,827,246 | A * | 10/1998 | Bowen | 604/313 |
| 6,202,689 | B1 * | 3/2001 | Williams | 137/602 |
| 6,450,995 | B1 * | 9/2002 | Prabhakar | 604/317 |
| 6,892,734 | B1 * | 5/2005 | Schleicher et al. | 128/889 |
| 7,901,389 | B2 * | 3/2011 | Mombrinie | 604/317 |
| 7,914,611 | B2 * | 3/2011 | Vrzalik et al. | 96/11 |
| 7,939,706 | B2 * | 5/2011 | Okabe et al. | 604/361 |
| 8,607,380 | B2 * | 12/2013 | Chang et al. | 5/114 |
| 2004/0236292 | A1 * | 11/2004 | Tazoe et al. | 604/317 |
| 2006/0015080 | A1 * | 1/2006 | Mahnensmith | 604/327 |
| 2006/0168736 | A1 | 8/2006 | Meyer | |
| 2007/0261548 | A1 | 11/2007 | Vrzalik et al. | |
| 2007/0266499 | A1 | 11/2007 | O'Keefe | |
| 2010/0016818 | A1 * | 1/2010 | Mahnensmith | 604/319 |
| 2011/0219548 | A1 * | 9/2011 | Vrzalik et al. | 5/699 |

OTHER PUBLICATIONS

Skin IQ Microclimate Manager "Clinical Support for Skin IQ™ Microclimate Manager", KCI Therapeutic Support Systems. © 2011, KCI Licensing, Inc. P.O. Box 659508, San Antonio, TX 78265-9508, 1-800-275-4524 or www.kciSkinIQ.com.

European Search Report for EP Application 13166242; Place of search—The Hague; date of completion of the search—Feb. 26, 2014.

EP Search Report Response for EP Application 13166242.1, Oct. 6, 2014.

EP Amended Pages—Tracked for EP Application 13166242.1.

EP Amended Pages—Clean for EP Application 13166242.1.

EP Amended Claims—Tracked for EP Application 13166242.1.

EP Amended Claims—Clean for EP Application 13166242.1.

* cited by examiner

OCCUPANT SUPPORT AND TOPPER ASSEMBLY WITH LIQUID REMOVAL AND MICROCLIMATE CONTROL CAPABILITIES

This application claims priority to provisional application 61/645,361 entitled "Occupant Support Apparatus and Topper Assembly with Liquid Removal and Microclimate Control Capabilities" filed on May 10, 2012, the contents of which are incorporated herein by reference.

TECHNICAL FIELD

The subject matter described herein relates to a support apparatus and a topper having features for removing liquid deposited thereon and for affecting the climatic environment in the immediate vicinity thereof. In one example application the support apparatus includes a mattress and a condition management assembly, and the condition management assembly includes a topper assembly comprising a topper, an air mover and a liquid reservoir.

BACKGROUND

Beds of the type used in hospitals, other health care facilities and residential health care settings include a mattress and may also include a topper which rests atop the mattress. Some toppers include microclimate control features which help regulate temperature and humidity in the immediate vicinity of the occupant of the bed in order to guard against breakdown of the occupant's skin tissue. Such toppers do not have the capacity to transport significant quantities of liquid away from the occupant's skin. Puddles of liquids may be present for a number of reasons such as incontinence, bleeding or wound exudate. The presence of liquid can be especially harmful to the occupant's skin. Accordingly, it is desirable to provide the capability to transport liquid away from the occupant's skin in addition to providing microclimate control.

SUMMARY

A topper assembly for a mattress comprises a liquid permeable cover layer, a liquid transport layer beneath the cover layer that transports liquid in a preferred direction, a liquid impermeable base layer beneath the transport layer, an air mover in fluid communication with the transport layer, and a reservoir positioned downstream of the liquid transport layer. Operation of the air mover moves air and liquid through the liquid transport layer in the preferred direction such that the reservoir captures liquid discharged from the liquid transport layer. A related support apparatus comprises a mattress and a condition management assembly atop the mattress. The condition management assembly includes the liquid transport layer, the liquid impermeable base layer, the air mover and the reservoir.

BRIEF DESCRIPTION OF THE DRAWINGS

The foregoing and other features of the various embodiments of the topper assembly and support apparatus described herein will become more apparent from the following detailed description and the accompanying drawings in which.

DETAILED DESCRIPTION

Figure 1:
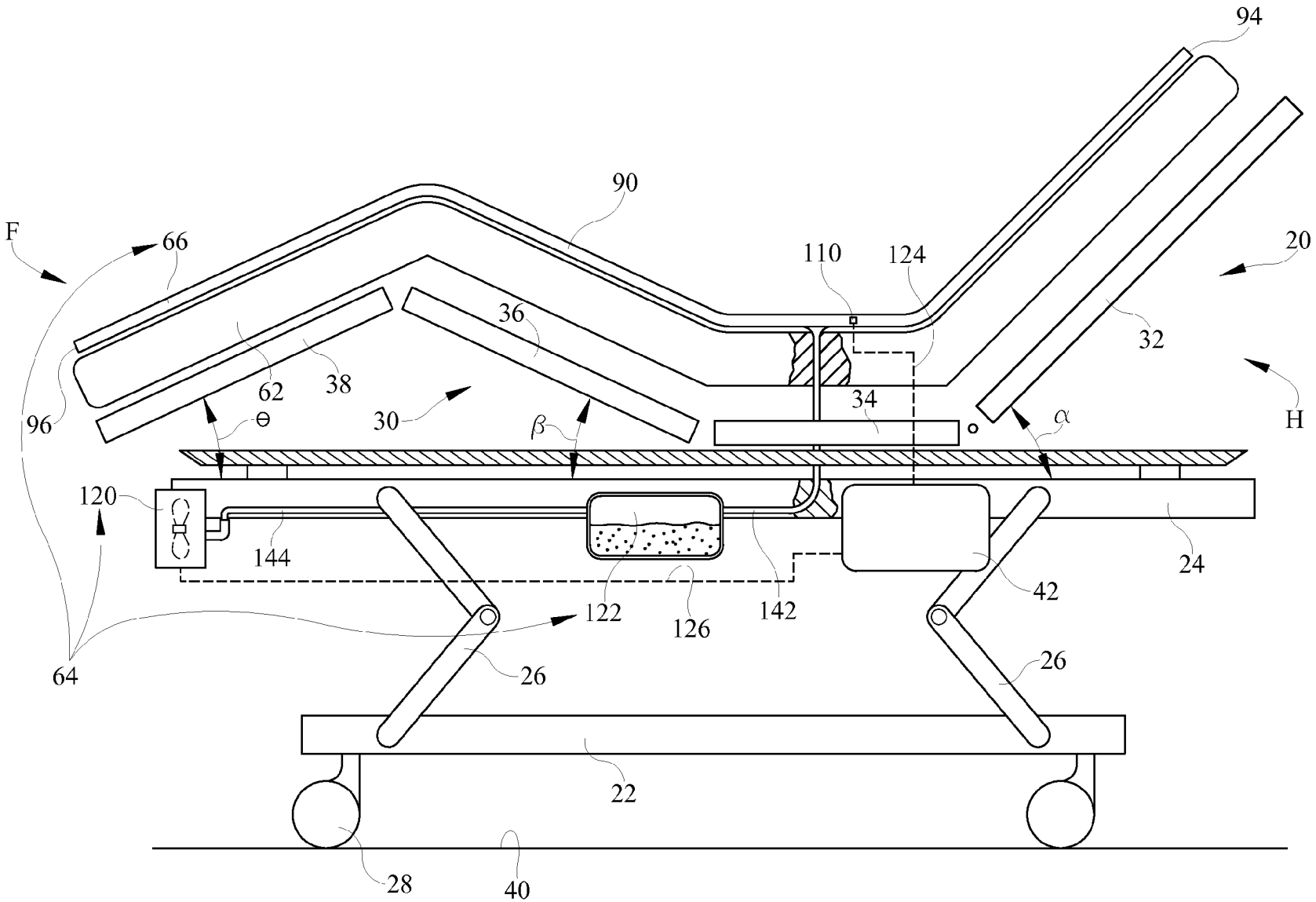
FIG. 1 is a simplified side elevation view of a hospital bed showing a "negative pressure" topper assembly and a related support apparatus.
Figure 2:
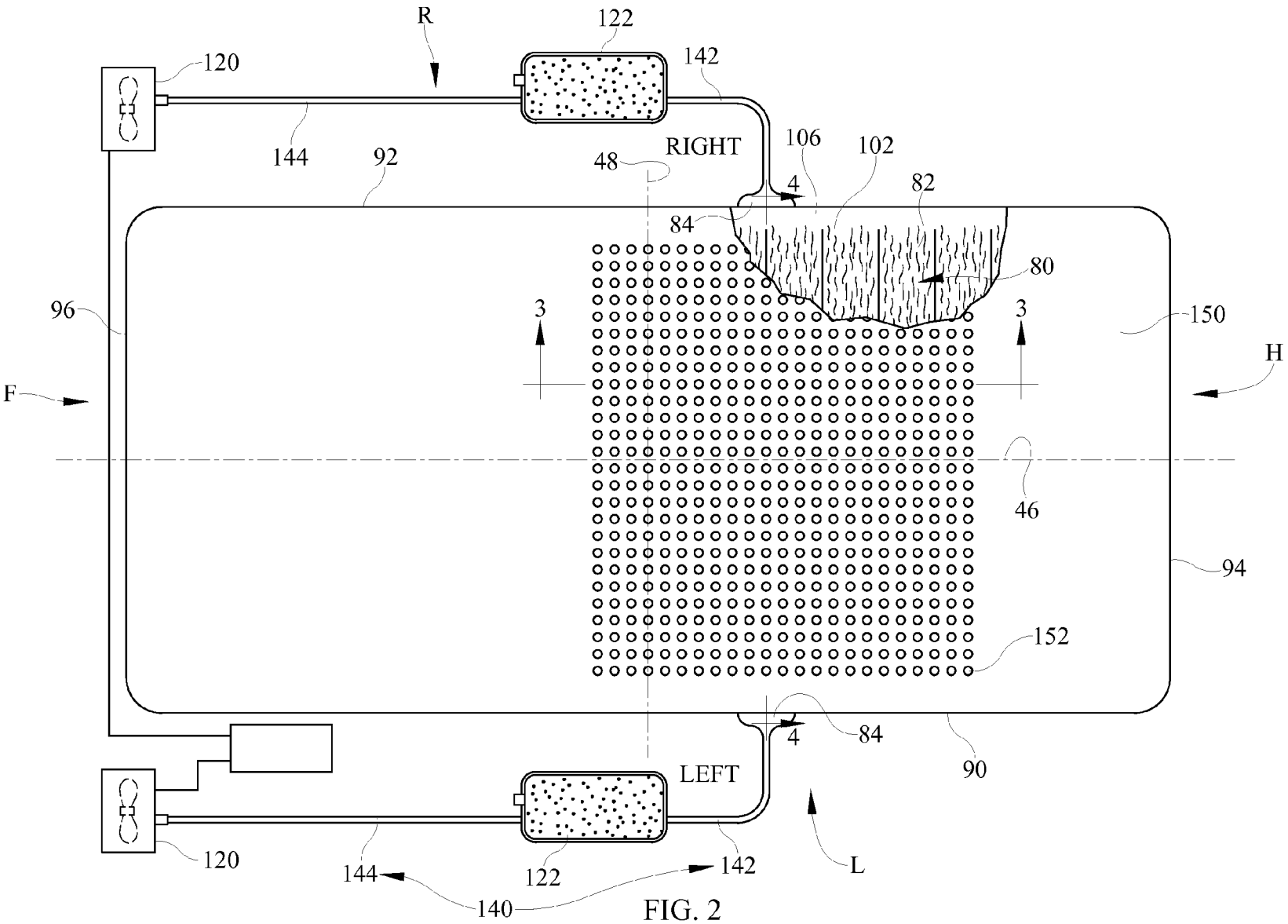
FIG. 2 is a plan view of the topper and other components of the topper assembly in which the topper component thereof includes an optional cover layer and in which a portion of the cover layer is broken away to expose a transport material of the transport layer.
Figure 3:
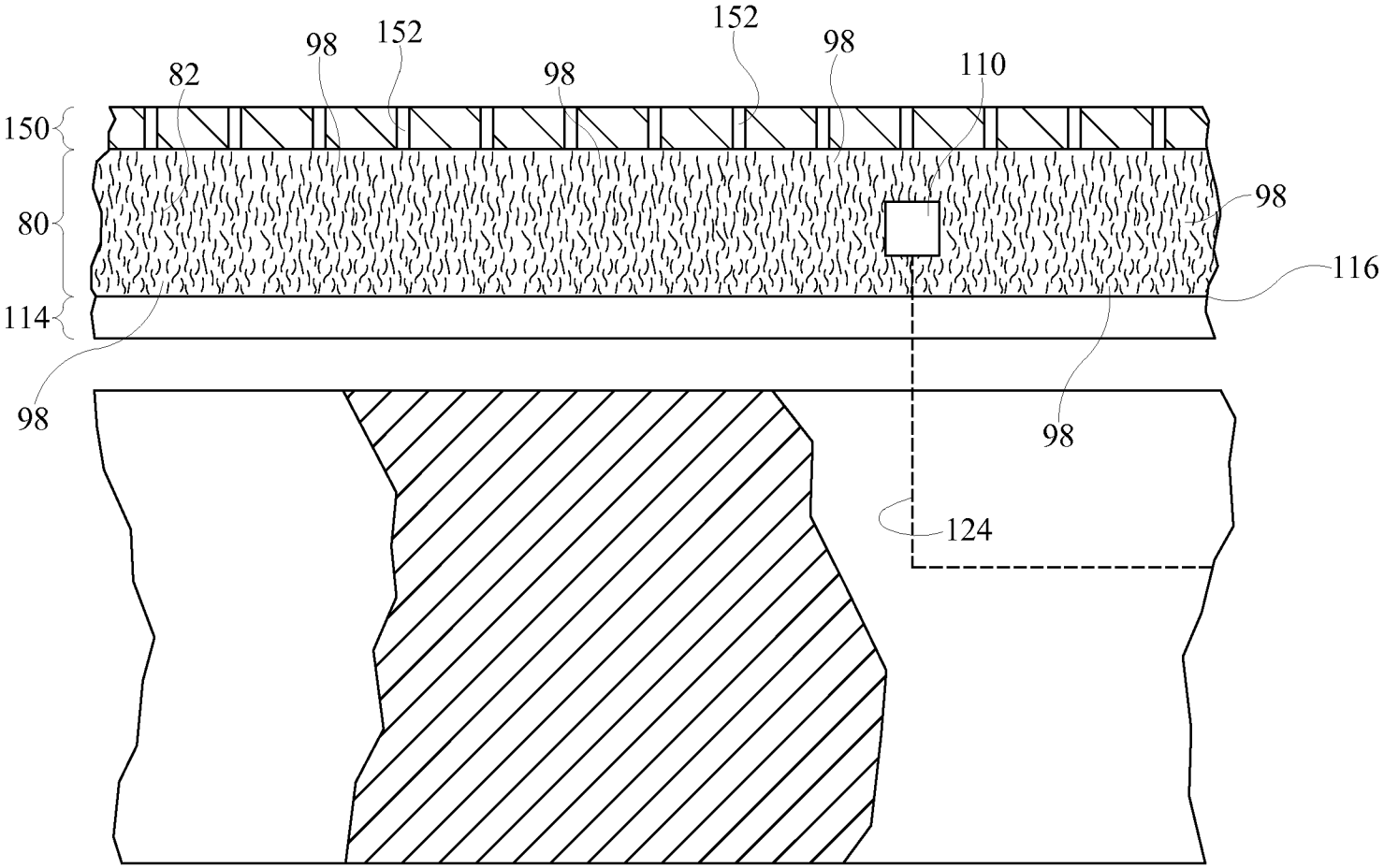
FIG. 3 is an enlarged view of a portion of FIG. 1 showing details of a topper component of the topper assembly in which the topper includes the optional cover layer, a liquid transport layer and a base layer.
Figure 4:
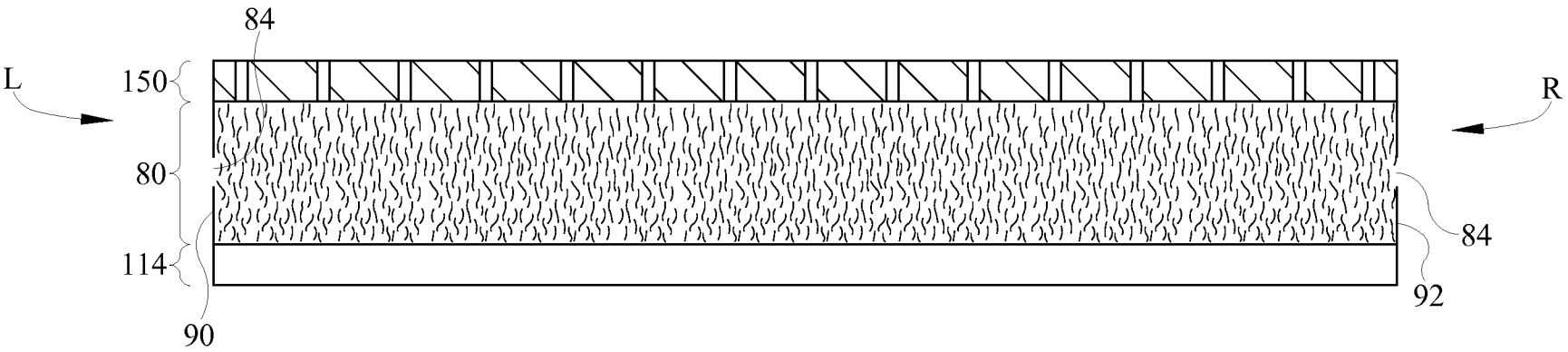
FIG. 4 is an end elevation view of the topper.

Referring to FIGS. 1-3, a hospital bed 20 includes a base frame 22 and an elevatable frame 24. A lift system represented by links 26 renders the elevatable frame vertically moveable relative to the base frame. The bed extends longitudinally from a head end H to a foot end F and laterally from a left side L (seen in the plane of FIG. 1) to a right side R. Casters 28 extend from the base frame to floor 40. The elevatable frame 24 includes a deck 30 comprising longitudinally distributed deck segments. The deck segments include an upper body or torso deck segment 32 corresponding approximately to an occupant's torso, a seat deck segment 34 corresponding approximately to an occupant's buttocks, a thigh deck segment 36 corresponding approximately to an occupant's thighs, and a calf deck segment 38 corresponding approximately to an occupant's calves. The upper body, calf, and thigh deck segments are orientation adjustable through angles $\alpha$, $\beta$ and $\theta$. The bed also includes a controller 42 for controlling various functions of the bed. Longitudinal and lateral centerlines 46, 48 extend in the longitudinal and lateral directions respectively.

The illustrated bed also includes a support apparatus 60 which comprises a mattress 62 for supporting a bed occupant and a condition management assembly for managing or regulating conditions in the immediate vicinity of the occupant. The condition management assembly may be integrated with the mattress, however is shown in the illustration as a separate topper assembly 64 which includes a topper 66 which may be placed on the mattress or not depending on the needs of the occupant. Such independent toppers typically include a zipper or other means, not illustrated, for temporarily securing the topper to the mattress. The topper has left, right, head and foot edges 90, 92, 94, 96, all of which are liquid impermeable.

A discharge opening 84 penetrates through each of the left and right edges 90, 92 of the topper.

The topper includes a liquid transport layer 80 comprising a liquid permeable filler material 82, also referred to as a transport material. The transport material has numerous liquid transport channels 98 sized for accommodating liquid transport therethrough under the influence of a gas pressure gradient. The transport channels are oriented or otherwise configured to direct the liquid predominantly in a preferred direction such as the lateral direction and particularly in a laterally outboard direction. i.e. away from longitudinal centerline 46 and toward left and right lateral edges 90, 92 of the topper. In the embodiment of FIGS. 1-3 the transport material does not extend laterally to topper edges 90, 92. As a result, topper edges 90, 92 and lateral edges 100, 102 of the transport material define pockets 104, 106 (only the right edge of the transport material and the right pocket are visible in FIG. 2; both edges and both pockets are visible in the embodiment of FIG. 5). The pockets may be empty as shown or may contain a material configured to encourage fluid flow toward openings 84, in which case the material can be the same transport material used elsewhere in the transport layer, but with directional properties that encourage fluid flow toward openings 84. The filler material is illustrated as fibrous mesh. Other suitable material architectures include open cell foam, open cell reticulated materials or other porous materials. One or more moisture sensors 110 responsive to the presence of liquid are positioned in or on the transport layer.

The topper also includes a liquid impermeable base layer 114 beneath the transport layer. The base layer is integral with or bonded to transport layer 80, at least along their perimeters, to prevent unregulated escape of liquid through juncture 116 between the base layer and the transport layer. One example of a material suitable for the base layer is polyurethane coated nylon.

Topper assembly 64 also includes an air mover 120 in fluid communication with transport layer 80 and a reservoir 122. As seen in FIGS. 1 and 3 the air mover is an exhaust fan. A communication line 124 between moisture sensor 110 and controller 42 enables the controller to receive signals indicating the presence or absence of liquid in the transport layer. A second communication line 126 between controller 42 and fan 120 enables the controller to convey commands to the fan. Alternatively, communication between the sensor and the controller and between the controller and air mover can be accomplished without a physical connection, e.g. wirelessly. A conduit 140 has a first branch 142 extending from topper transport layer 80 to reservoir 122 and a second branch 144 extending from reservoir 122 to fan 120. Because fan 120 is an exhaust fan its operation suctions air away from the topper. The fan is therefore downstream of the topper, and thus downstream of the transport layer, with the reservoir residing streamwisely between the transport layer and the fan. More specifically, operation of the fan moves air, and any liquid which may be present in the transport layer, from the transport layer in the preferred direction established by the fluid flow directing properties of the material from which the transport layer is constructed. The air and liquid flow through conduit branch 142 to reservoir 122 such that the reservoir captures the liquid from the liquid transport layer. The air then flows through conduit branch 144. The fan creates suction in the transport layer sufficiently large to draw liquid through the transport layer in the preferred direction and cause the liquid to enter the reservoir.

The topper component 66 of the illustrated topper assembly 64 also includes an optional liquid permeable cover layer 150 atop the transport layer. The cover layer in the illustration is liquid permeable by virtue of openings 152 penetrating through a material that is otherwise liquid impermeable, such as a polyurethane coated nylon. The openings are distributed over at least the longitudinal portion of the topper corresponding approximately to the expected position of an occupant's buttocks and torso. The presence of the cover layer is desirable if, for example, an occupant would find direct contact with the transport layer to be uncomfortable and/or if the transport layer could not be easily cleaned. The cover layer can then provide the required occupant comfort and cleanability. If a cover layer is used it is envisioned that the features which impart liquid permeability to the cover layer, e.g. openings 152, would be longitudinally and laterally coextensive with the transport material.

Figure 5:
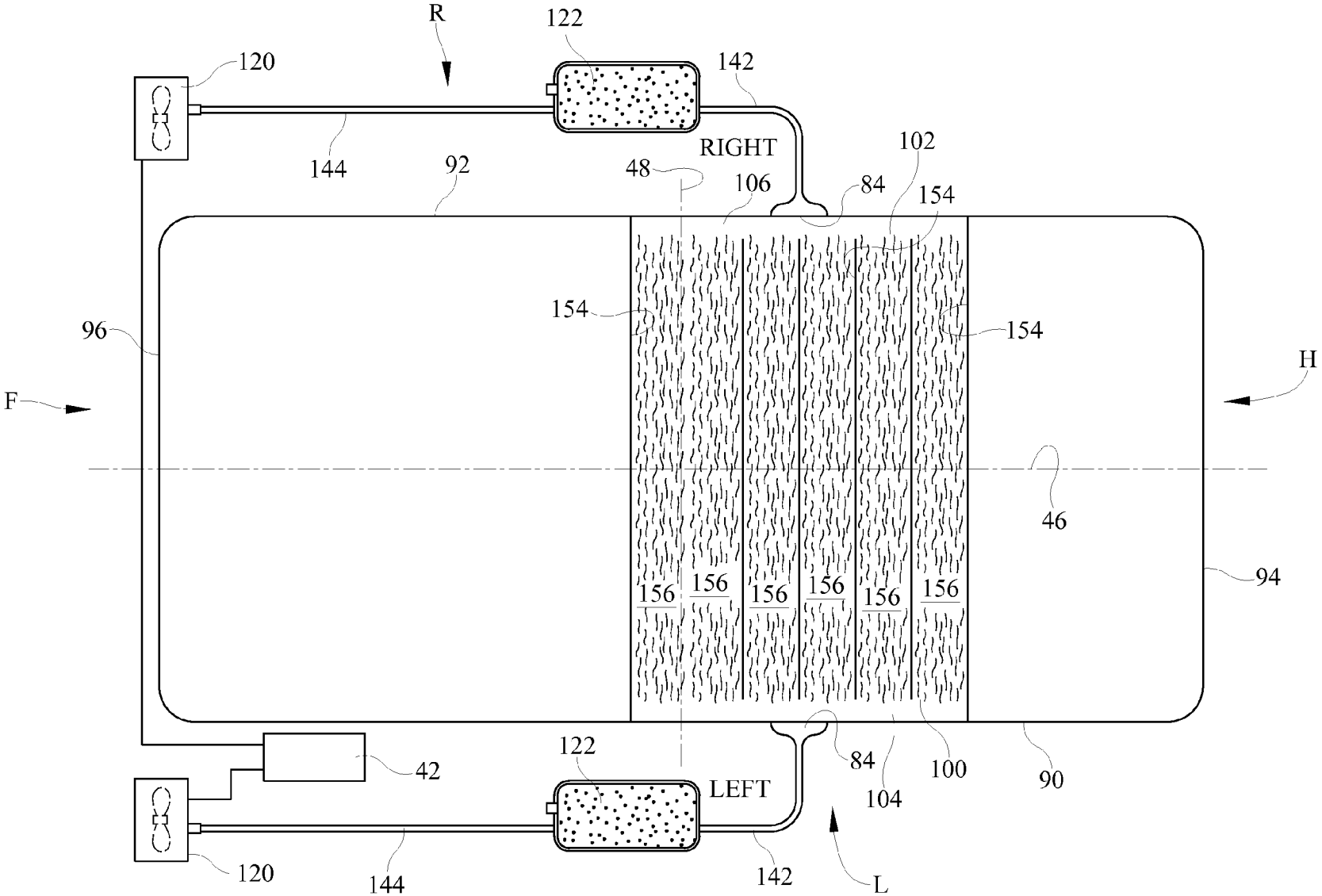
FIG. 5 is a view similar to FIG. 2 showing a variant of the transport layer in which the transport material is present in only a limited longitudinal portion of the transport layer and in which partitions extend laterally across the transport layer and in which the transport material and longitudinally interior partitions do not extend to the lateral edges of the topper.

FIG. 5 shows a variant of the transport layer in which the transport material is present in only that longitudinal portion of the transport layer corresponding approximately to the expected position of an occupant's buttocks and torso since this is the region where an incontinent occupant is most likely to deposit urine. If desired the transport material may be present in a larger region of the transport layer. In the variant of FIG. 5 laterally extending partitions 154 define compartments 156. The longitudinally outermost partitions extend to the edges of the transport layer. The longitudinally inner partitions are slightly foreshortened so that they terminate laterally inboard of the transport layer edges. Because of their orientation in the preferred direction of liquid transport, the partitions augment or reinforce the directional properties of the transport material.

Figures 6A, 6B, 6C:
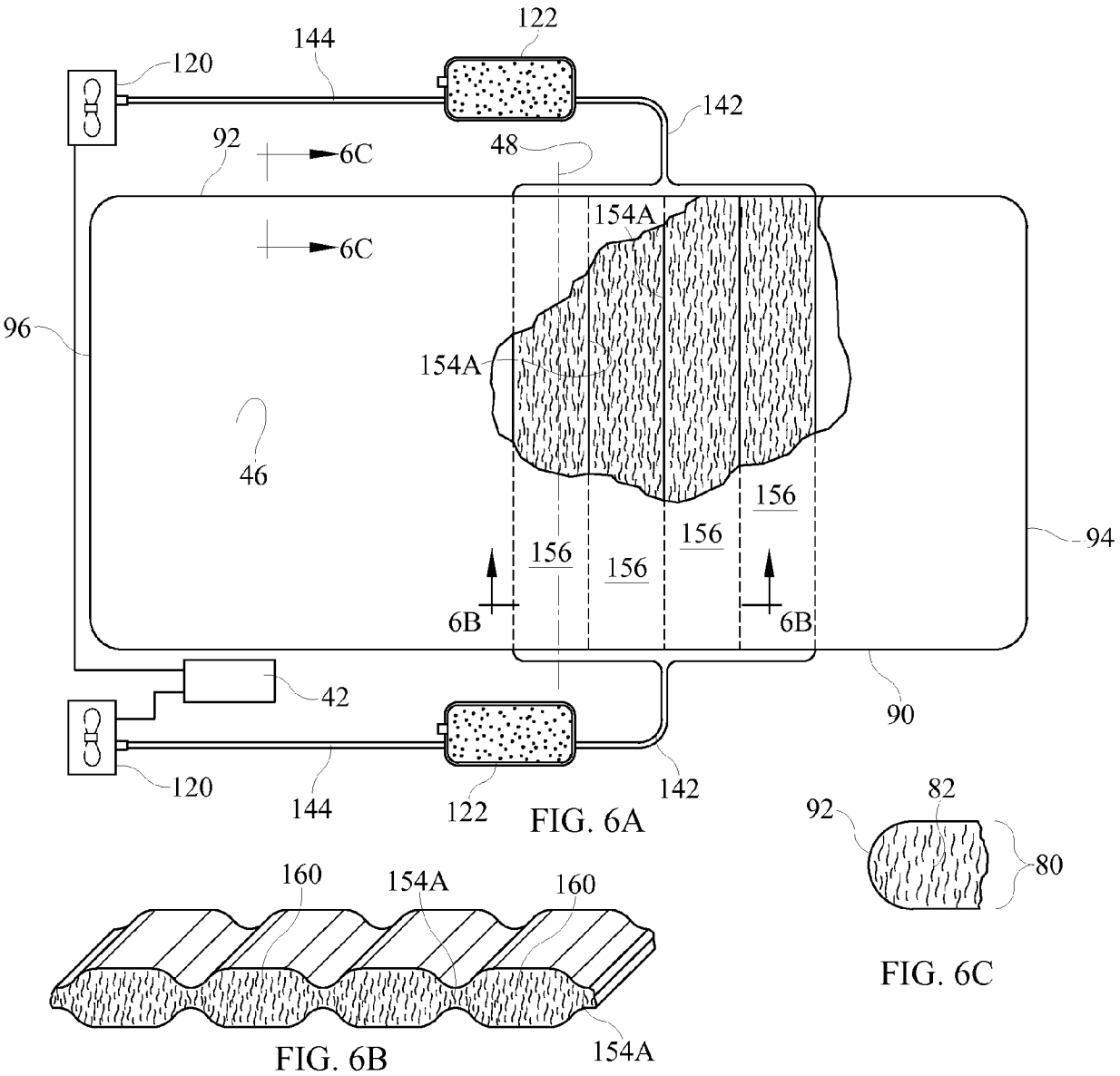
FIGS. 6A-6C are views showing a variant of the transport layer in which partitions are formed by pinching the transport material together and in which the transport material extends to the lateral edges of the topper.

FIGS. 6A-6C shows a variant in which partitions are formed by pinching the transport material together. The pinch-formed partitions are designated 154A to distinguish them from the panel style partitions 154 seen in other views. Each compartment has a dedicated opening 160 longitudinally bounded by the lateral extremities of two neighboring partitions. Because each compartment extends to left and right edges 90, 92, the filler material can also extend to the edges rather than being laterally foreshortened as in FIG. 3. Although FIGS. 6A-6C show longitudinally limited distribution of the transport material used in conjunction with partitions, the features (limited distribution and partitions) can be used individually. In addition, panel style partitions 154 could be used in lieu of the pinch-formed partitions 154A.

In operation, sensor 110 monitors the transport layer for the presence of liquids such as urine, wound exudate, blood, and spilled IV fluids to name just a few. Controller 42 receives data from the sensor indicating the presence or absence of liquid in the transport layer. If no liquid is present the controller commands fan 120 to operate in a climate management mode. In the climate management mode the fan operates at a speed sufficient to draw ambient air along a flowpath comprising openings 152 in cover layer 150 (if the cover layer is present) liquid transport layer 80, opening 84 (or openings 160 of FIG. 6B), conduit branch 142, reservoir 122, and conduit branch 144. As a result, the support apparatus exhibits a microclimate control capability in which topper 66 serves as a microclimate control topper to control temperature and humidity in the immediate vicinity of a bed occupant. However if liquid is detected in the transport layer, the controller commands fan 120 to operate in a liquid management mode. In the liquid management mode the fan operates at a speed sufficient to draw ambient air along the flowpath described above and to also create enough of a pressure gradient to draw the liquid through the transport layer in the preferred direction and cause the liquid to enter reservoir 122. As a result, the support apparatus exhibits both a microclimate control capability as described above and a liquid extraction capability to remove liquid that would otherwise puddle under the bed occupant and expose him or her to an elevated risk of skin tissue breakdown.

Figure 7:
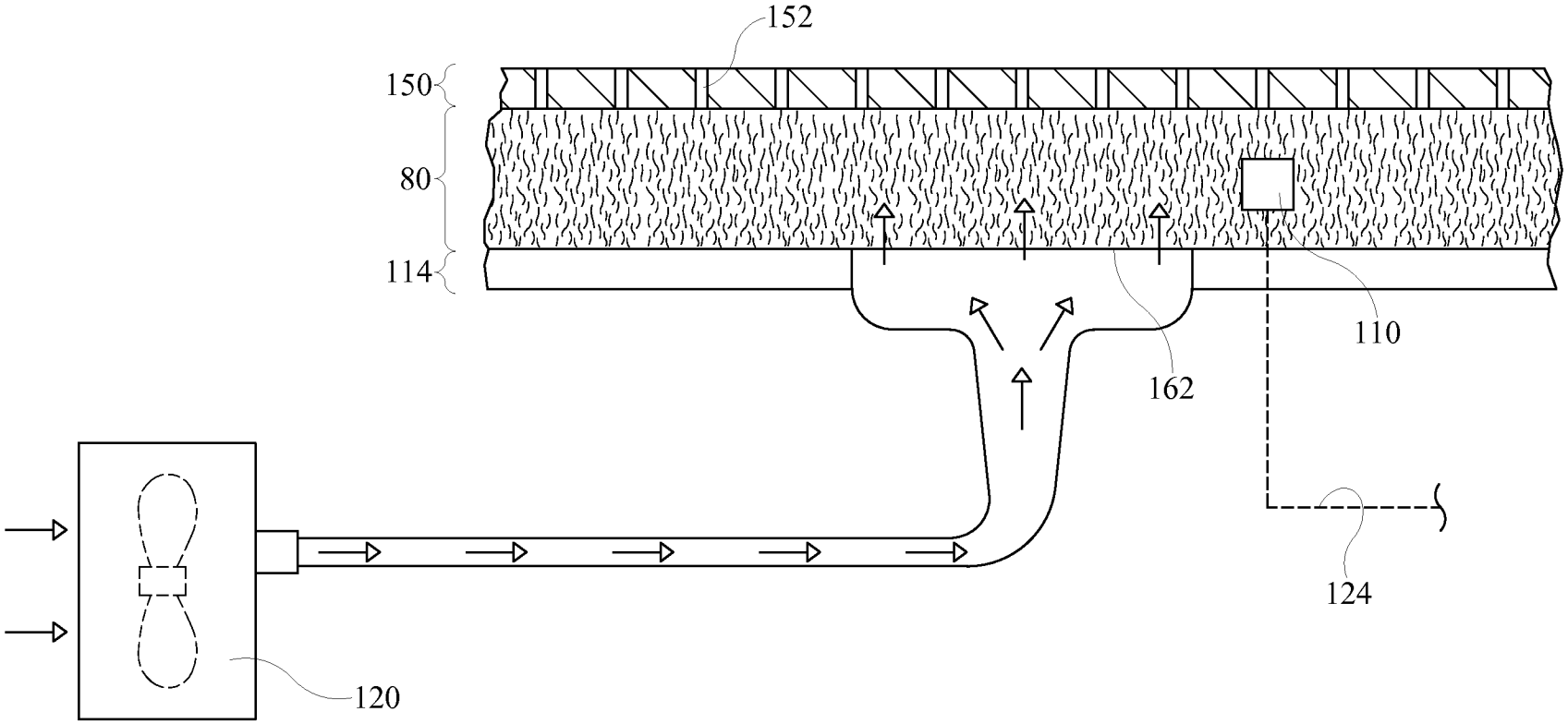
FIGS. 7-8 are a side elevation view and a plan view showing a "positive pressure" variant of the topper assembly.
Figure 8:
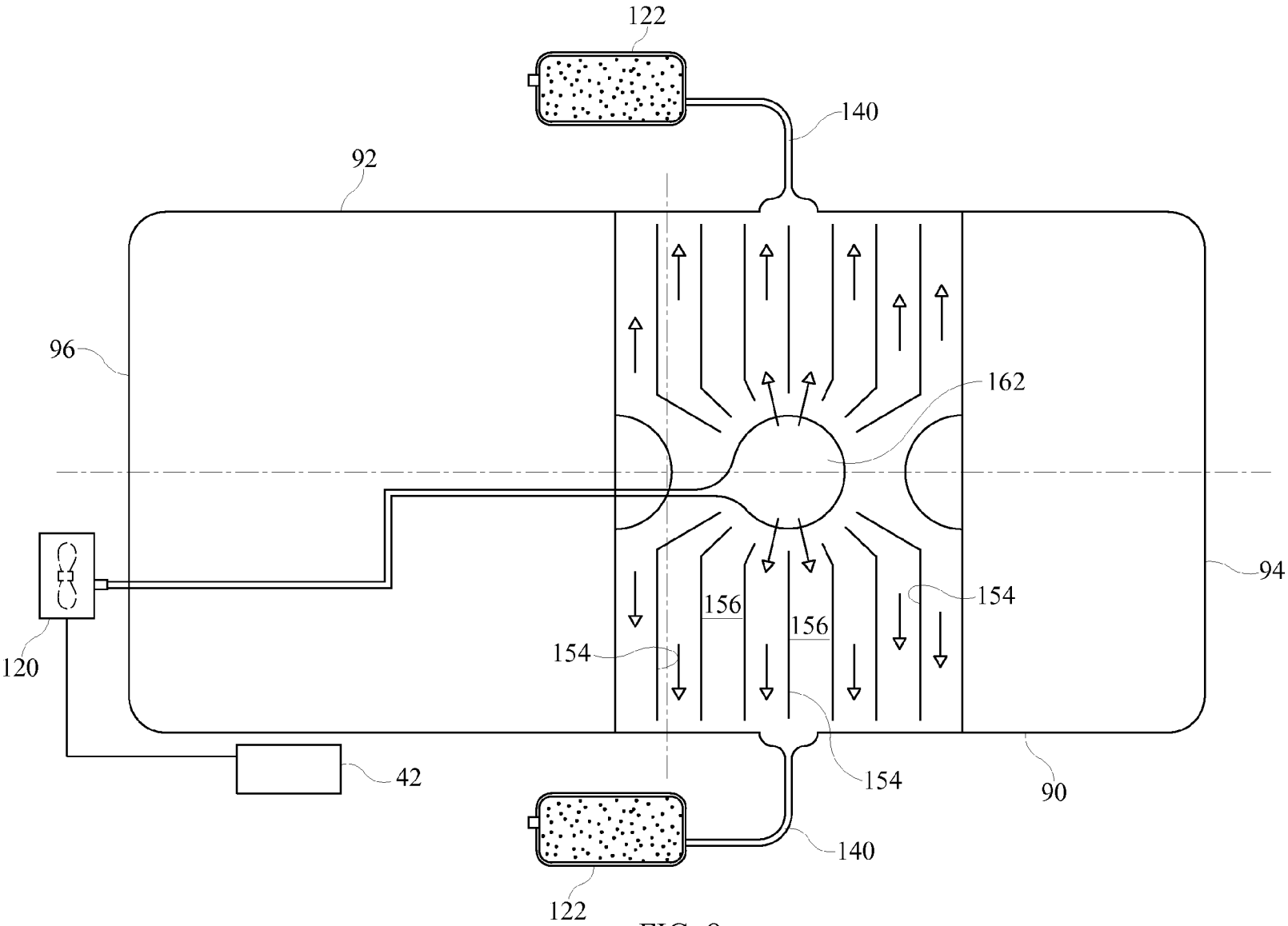

Because the air mover in the above described variants is downstream of the transport layer, these embodiments may be thought of as "negative pressure" variants. FIGS. 7-8 show a "positive pressure" variant in which the air mover is a fan upstream of the transport layer and in which the reservoir is downstream of the transport layer. The fan or other air mover is configured to create pressure in the transport layer sufficiently large to force liquid that might be present in the transport layer through the transport layer in the preferred direction and cause the liquid to enter the reservoir. The variant of FIGS. 7-8 includes partitions oriented radially in the vicinity of air intake port 162 and extending laterally elsewhere in the transport layer. The variant of FIGS. 7-8 operates similarly to those of FIGS. 1-6.

Figure 9:
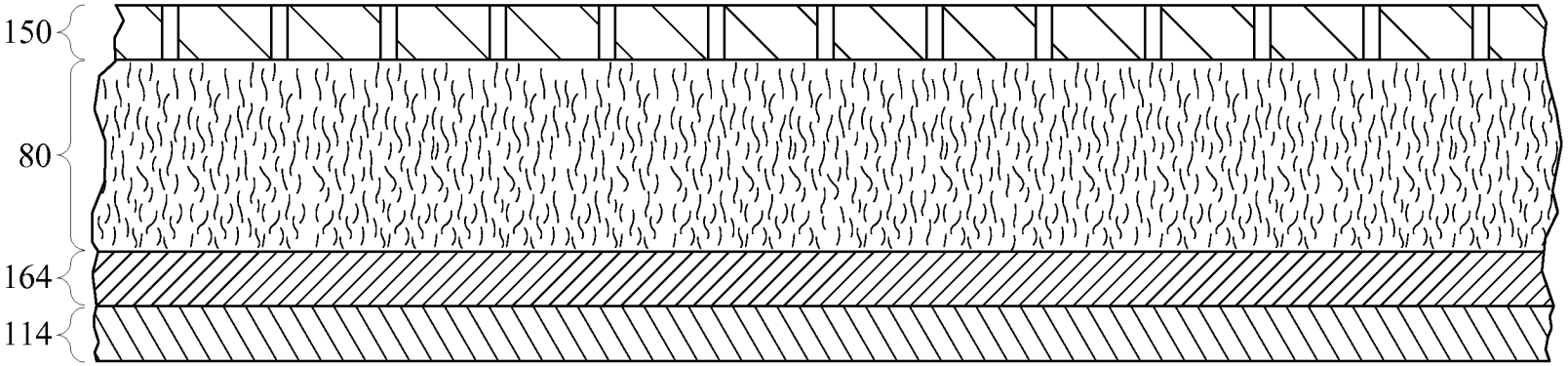
FIG. 9 is a side elevation view of a portion of a topper which includes a dessicant layer between the transport layer and the base layer.

FIG. 9 shows a variant of the topper which includes a dessicant layer 164 between transport layer 80 and the base layer 114. The dessicant layer helps remove residual moisture from the transport layer.

Figure 10:
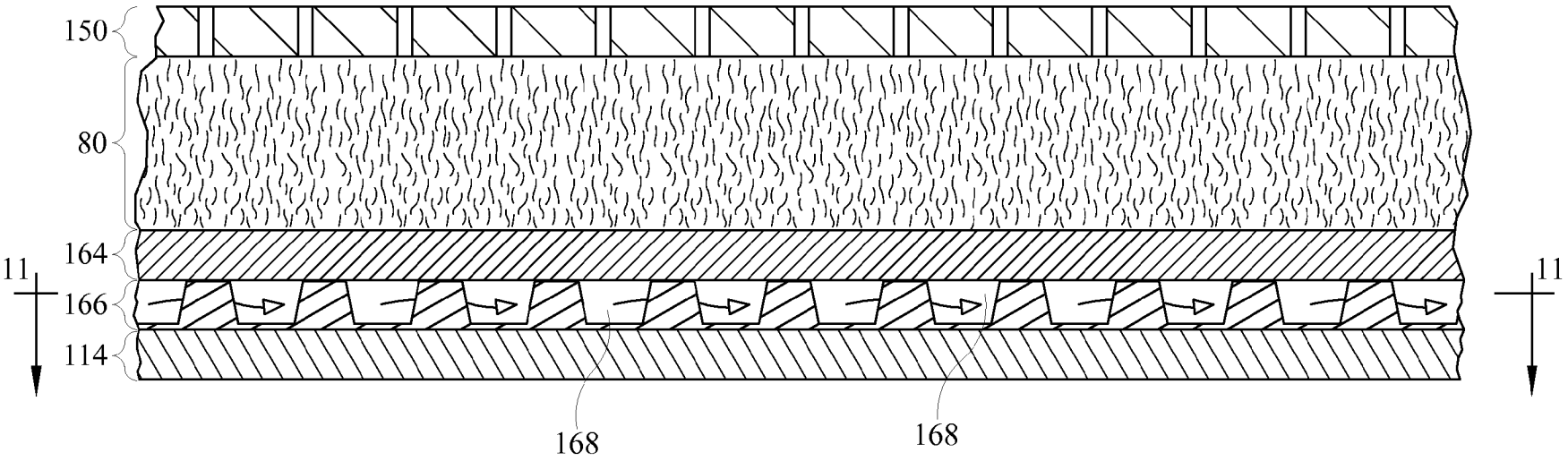
FIGS. 10-11 are a side elevation view similar to FIG. 9 and a plan view in which the topper includes a spacer layer beneath the dessicant layer.
Figure 11:
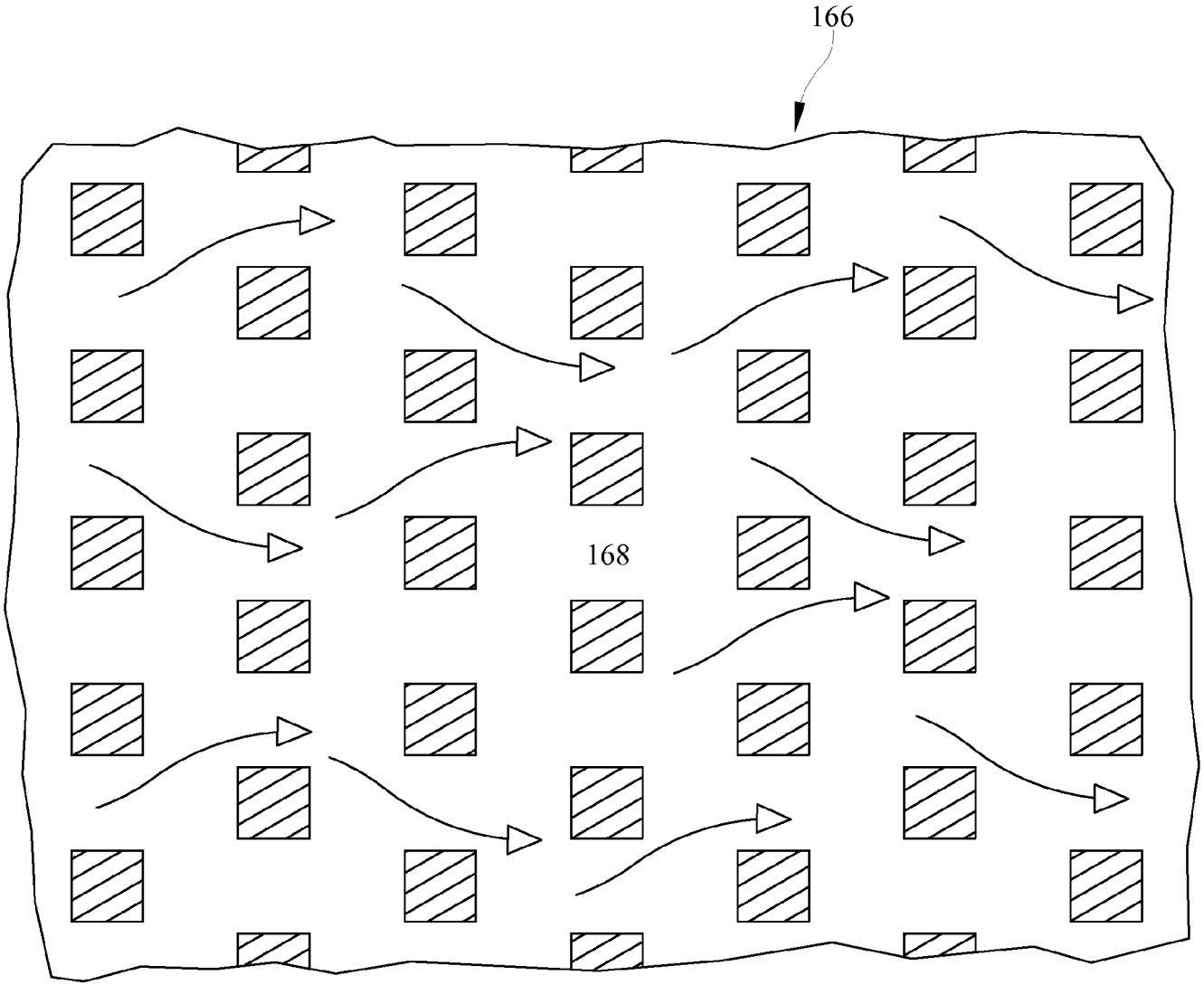

FIGS. 10-11 shows a variant of the topper which includes not only dessicant layer 164 but also a spacer layer 166 beneath the dessicant layer. The spacer layer establishes a dessicant refresher flowpath 168. An air impeller, not shown, forces air through the refresher flowpath to dry the dessicant, thus refreshing it and extending its useful life. The air impeller for the refresher flowpath may be the fan 120 already described or may be a distinct device.

Figure 12:
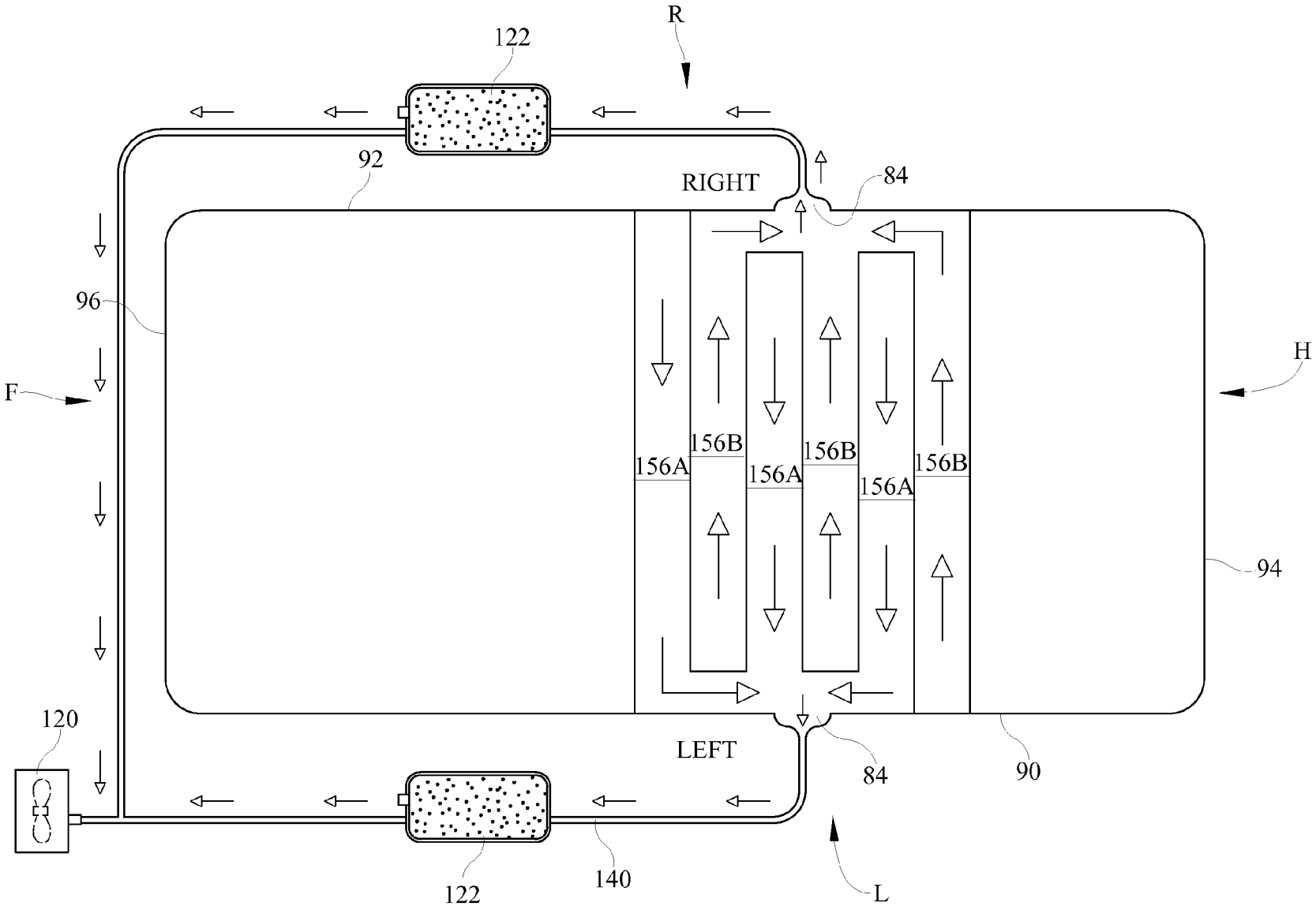
FIG. 12 is a plan view showing a negative pressure variant of the topper assembly featuring nested compartments each with three legs distributed longitudinally and alternately with the legs of the other compartment.
Figure 13:
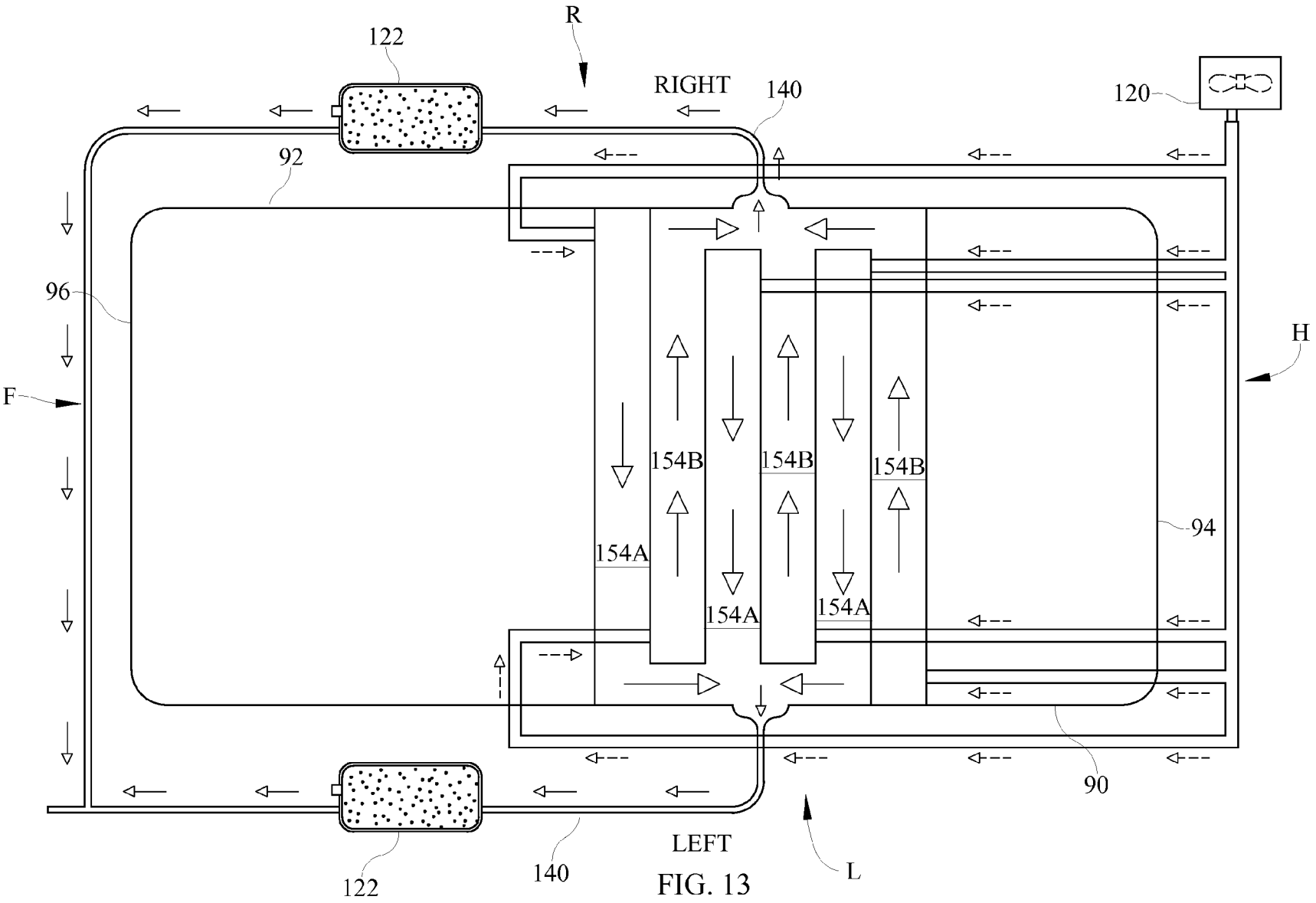
FIG. 13 is a plan view similar to FIG. 12 showing a positive pressure variant.

FIG. 12 shows a negative pressure arrangement featuring nested compartments 156A, 156B each with three legs distributed longitudinally and alternately with the legs of the other compartment. FIG. 13 shows a similar positive pressure nested arrangement.

Although this disclosure refers to specific embodiments, it will be understood by those skilled in the art that various changes in form and detail may be made without departing from the subject matter set forth in the accompanying claims.

We claim:

1. A topper assembly for a mattress comprising:

a liquid permeable cover layer;

a liquid transport layer beneath the cover layer, the liquid transport layer comprising a liquid permeable filler material having liquid flow channels sized to permit liquid transport therethrough and oriented to direct the liquid in a preferred direction;

a liquid impermeable base layer beneath the transport layer;

an air mover in fluid communication with the transport layer wherein operation of the air mover moves air and liquid through the liquid transport layer in the preferred direction; and a reservoir positioned downstream of the liquid transport layer such that the reservoir captures liquid discharged from the liquid transport layer.

2. The assembly of claim 1 wherein the topper assembly has a head end, a foot end spaced from the head end in a longitudinal direction, a left side, a right side spaced from the left side in a lateral direction and wherein the preferred direction is the lateral direction.

3. The assembly of claim 2 wherein the preferred direction is a laterally outboard direction.

4. The assembly of claim 1 wherein openings penetrate through the cover layer, the cover layer being otherwise liquid impermeable.

5. The assembly of claim 1 wherein the air mover is downstream of the transport layer, the reservoir is streamwisely between the transport layer and the air mover, and the air mover is configured to create suction in the transport layer sufficiently large to draw liquid through the transport layer in the preferred direction and cause the liquid to enter the reservoir.

6. The assembly of claim 1 wherein the air mover is upstream of the transport layer, the reservoir is downstream of the transport layer and the air mover is configured to create pressure in the transport layer sufficiently large to force liquid through the transport layer in the preferred direction and cause the liquid to enter the reservoir.

7. The assembly of claim 1 including a desiccant layer between the transport layer and the base layer.

8. The assembly of claim 7 including a spacer beneath the desiccant layer to establish a desiccant refresher flowpath.

9. The assembly of claim 1 comprising a moisture sensor responsive to liquid present in the transport layer and a controller which produces a command for operating the air mover in response to a moisture indication from the sensor.

10. The assembly of claim 1 wherein the liquid transport layer includes partitions extending in the preferred direction.

11. The assembly of claim 1 wherein the preferred direction is nonvertical.

12. A support apparatus comprising:

a mattress;

a condition management assembly atop the mattress comprising:

a liquid transport layer comprising a liquid permeable filler material having liquid flow channels sized for accommodating liquid transport therethrough and oriented to direct the liquid in a preferred direction;

a liquid impermeable base layer beneath the transport layer;

an air mover in fluid communication with the transport layer wherein operation of the air mover moves air and liquid through the liquid transport layer in the preferred direction; and a reservoir positioned downstream of the liquid transport layer such that the reservoir captures liquid discharged from the liquid transport layer.

13. The assembly of claim 12 wherein the topper assembly has a head end, a foot end spaced from the head end in a longitudinal direction, a left side, a right side spaced from the left side in a lateral direction and wherein the preferred direction is the lateral direction.

14. The assembly of claim 13 wherein the preferred direction is a laterally outboard direction.

15. The assembly of claim 12 including a liquid permeable cover layer atop the liquid transport layer.

16. The assembly of claim 12 wherein the air mover is downstream of the transport layer, the reservoir is streamwisely between the transport layer and the air mover, and the air mover is configured to create suction in the transport layer sufficiently large to draw liquid through the transport layer in the preferred direction and cause the liquid to enter the reservoir.

17. The assembly of claim 12 wherein the air mover is upstream of the transport layer, the reservoir is downstream of the transport layer and the air mover is configured to create pressure in the transport layer sufficiently large to force liquid through the transport layer in the preferred direction and cause the liquid to enter the reservoir.

18. The assembly of claim 12 including a desiccant layer between the transport layer and the base layer.

19. The assembly of claim 18 including a spacer beneath the desiccant layer to establish a desiccant refresher flowpath.

20. The assembly of claim 12 comprising a moisture sensor responsive to liquid present in the transport layer and a controller which produces a command for operating the air mover in response to a moisture indication from the sensor.

21. The assembly of claim 12 wherein the liquid transport layer includes partitions extending in the preferred direction.

22. The assembly of claim 12 wherein the preferred direction is nonvertical.

* * * * *